US006408859B1

(12) United States Patent
Shyu

(10) Patent No.: US 6,408,859 B1
(45) Date of Patent: Jun. 25, 2002

(54) DEVICE FOR STYLING HAIR

(76) Inventor: Shyh Ming Shyu, No. 119, Lane 234, Chengbei Road, Tainan (TW), 708

( * ) Notice: Subject to any disclaimer, the term of this patent is extended or adjusted under 35 U.S.C. 154(b) by 0 days.

(21) Appl. No.: 09/860,691

(22) Filed: May 21, 2001

(51) Int. Cl.[7] ..... A45D 8/00; A45D 8/20
(52) U.S. Cl. ..... 132/276; 132/277
(58) Field of Search ..... 132/277, 276, 132/273, 275, 278, 279; D28/38, 39, 40, 41

(56) References Cited

U.S. PATENT DOCUMENTS 2,082,938 A * 6/1937 Belloch ..... 132/277
3,698,403 A * 10/1972 Morand ..... 132/277
5,396,912 A * 3/1995 Chou ..... 132/279
5,520,201 A * 5/1996 Hart et al. ..... 132/277
5,676,166 A * 10/1997 Chang ..... 132/279
5,699,814 A * 12/1997 Potut ..... 132/277
5,873,377 A * 2/1999 Yang ..... 132/277
5,979,467 A * 11/1999 Potut et al. ..... 132/277
6,019,108 A * 2/2000 Chen ..... 132/276
6,192,894 B1 * 2/2001 Yasuda ..... 132/277

* cited by examiner

*Primary Examiner*—John J. Wilson
*Assistant Examiner*—Robyn Kieu Doan
(74) *Attorney, Agent, or Firm*—Charles E. Baxley

(57) ABSTRACT

A hair styling device includes a clasp plate having two ears, and another clasp plate having a block engaged between the ears. A coil spring is received in the block and has two legs extended between the block and the ears and engaged with the clasp plates. A shaft is engaged through the ears and the coil spring for pivotally securing the clasp plates together. The coil spring may be stably retained and shielded in the block while assembling, such that the coil spring may be prevented from hurting the other people inadvertently and may be prevented from being dirtied or rusted.

3 Claims, 5 Drawing Sheets

DEVICE FOR STYLING HAIR

BACKGROUND OF THE INVENTION

1. Field of the Invention

The present invention relates to a device, and more particularly to a device for styling hairs.

2. Description of the Prior Art

Various kinds of hair styling devices or hair clasps or hair clips have been developed. As shown in FIGS. 1 and 2, one of the typical hair styling devices is shown and comprises two clasp plates 8, 9 each including a handle 81, 91 extended therefrom, and each including a pair of ears 82, 92 extended therefrom. The ears 82, 92 each includes an orifice 83, 93 formed therein. The distance between the ears 92 of the clasp plate 9 is smaller than that of the ears 82 such that the ears 92 may be disposed between the ears 82, and such that the orifices 83, 93 of the ears 82, 92 may be aligned with each other for receiving a shaft 7 therein. A coil spring 6 is to be engaged into and disposed between the ears 82, 92 and to be aligned with the orifices 83, 93 of the ears 82, 92 for allowing the shaft 7 to be engaged into the coil spring 6. The coil spring 6 includes two legs 60 for engaging with the handless 81, 91 of the clasp plates 8, 9 respectively for biasing the clasp plates toward each other and for hair styling purposes. As best shown in FIG. 2, two tubes 5 are required to be engaged onto the legs 60 of the coil spring 6 for forcing the legs 60 toward each other and for allowing the coil spring 6 to be engaged into and disposed between the ears 82, 92 and for allowing the shaft 7 to be engaged through the coil spring 6 and the orifices 83, 93 of the ears 82, 92.

However, as shown in FIG. 2, the coil spring 6 may be sprung out or disengaged from the tubes 5 and may hurt people inadvertently, particularly, the eyes will be easily damaged or hurt by the sprung out coil spring 6. In addition, when assembling the hair clips, one hand of the worker is required to hold the tubes 5, and the other hand is required to adjust or hold the clasp plates 8, 9 and to align the ears 82, 92 with the coil spring 6 and to engage the shaft 7 through the ears 82, 92 and the coil spring 6. The hair clips thus may not be easily and quickly assembled. Furthermore, the coil spring 6 is exposed and may be easily contaminated by the dirt or the like, and may be easily rusted.

The present invention has arisen to mitigate and/or obviate the afore-described disadvantages of the conventional hair clips.

SUMMARY OF THE INVENTION

The primary objective of the present invention is to provide a hair styling device including a structure for allowing the hair styling device to be easily manufactured and assembled.

The other objective of the present invention is to provide a hair styling device including a coil spring that may be stably retained in place during assembling, for preventing the coil spring from hurting the other people inadvertently.

The further objective of the present invention is to provide a hair styling device including a coil spring that may be shielded or received in a block for preventing the coil spring from being dirtied or contaminated or rusted.

In accordance with one aspect of the invention, there is provided a hair styling device comprising a first clasp plate including a comb provided therein, and including a block extended therefrom, the block including an aperture formed therein, a second clasp plate including a comb provided therein, and including a pair of ears extended therefrom, the ears each including a hole formed therein and to be aligned with the aperture of the block, a coil spring received in the aperture of the block and including an orifice formed therein, and including two legs extended between the block and the ears and engaged with the first and the second clasp plates respectively for biasing the combs toward each other, and a shaft engaged through the holes of the ears and the orifice of the coil spring for pivotally securing the clasp plates together. The coil spring may be stably retained in the aperture of the block while assembling, such that the coil spring may be prevented from being disengaged from the block and may be prevented from hurting the other people inadvertently, and such that the hair styling device may be easily manufactured and assembled. The coil spring may be suitably shielded or received in the block and may thus be prevented from being exposed and contacted with the environment air, such that the coil spring may be prevented from being dirtied or contaminated or rusted.

The block includes a channel formed therein and communicating with the aperture of the block for receiving the legs of the coil spring.

The first and the second clasp plates each includes a handle provided thereon for moving the combs away from each other against the coil spring.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
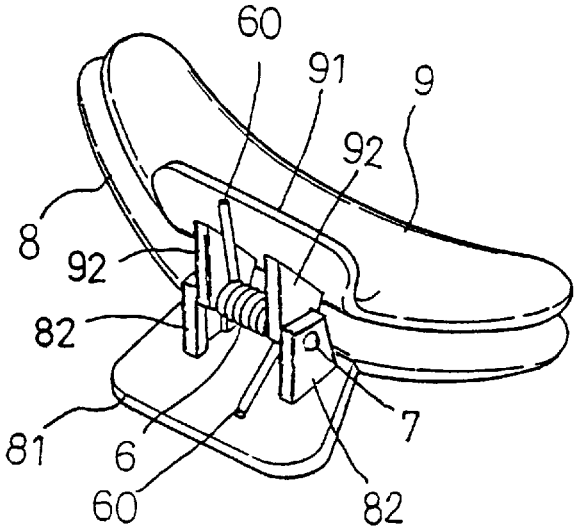
FIG. 1 PRIOR ART
FIG. 1 is a perspective view illustrating a typical hair clip.
Figure 2:
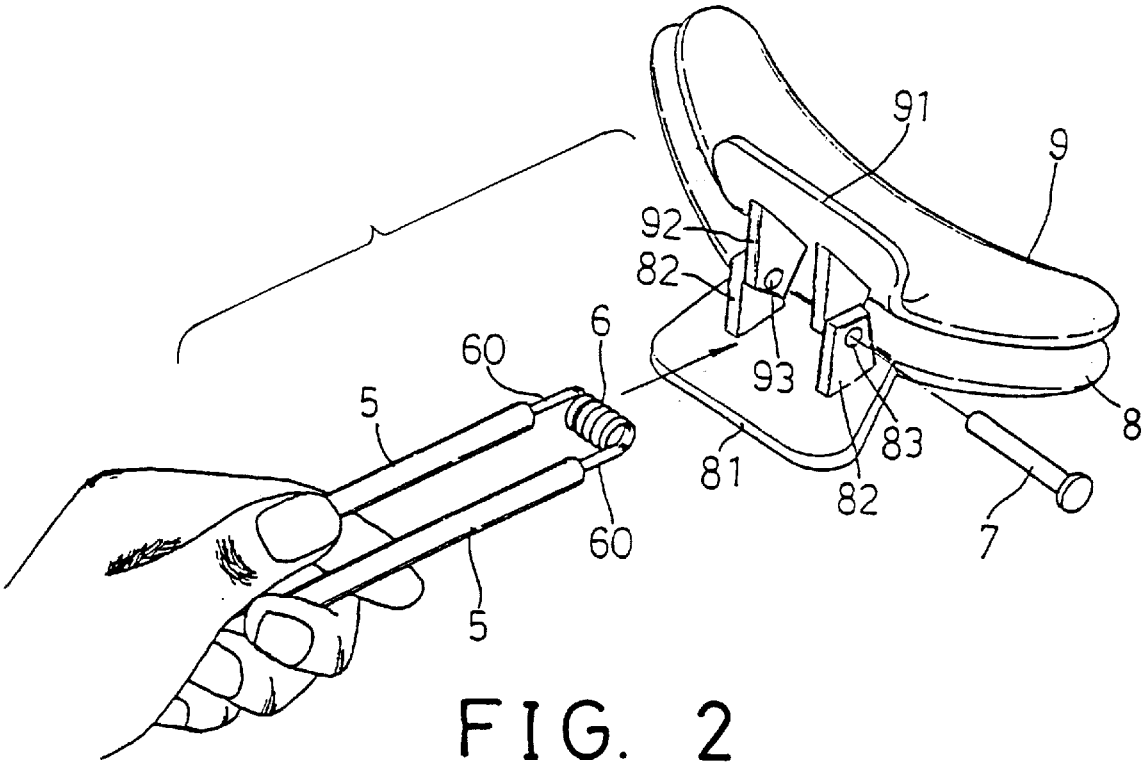
FIG. 2 PRIOR ART
FIG. 2 is a partial exploded view of the hair clip.
Figure 3:
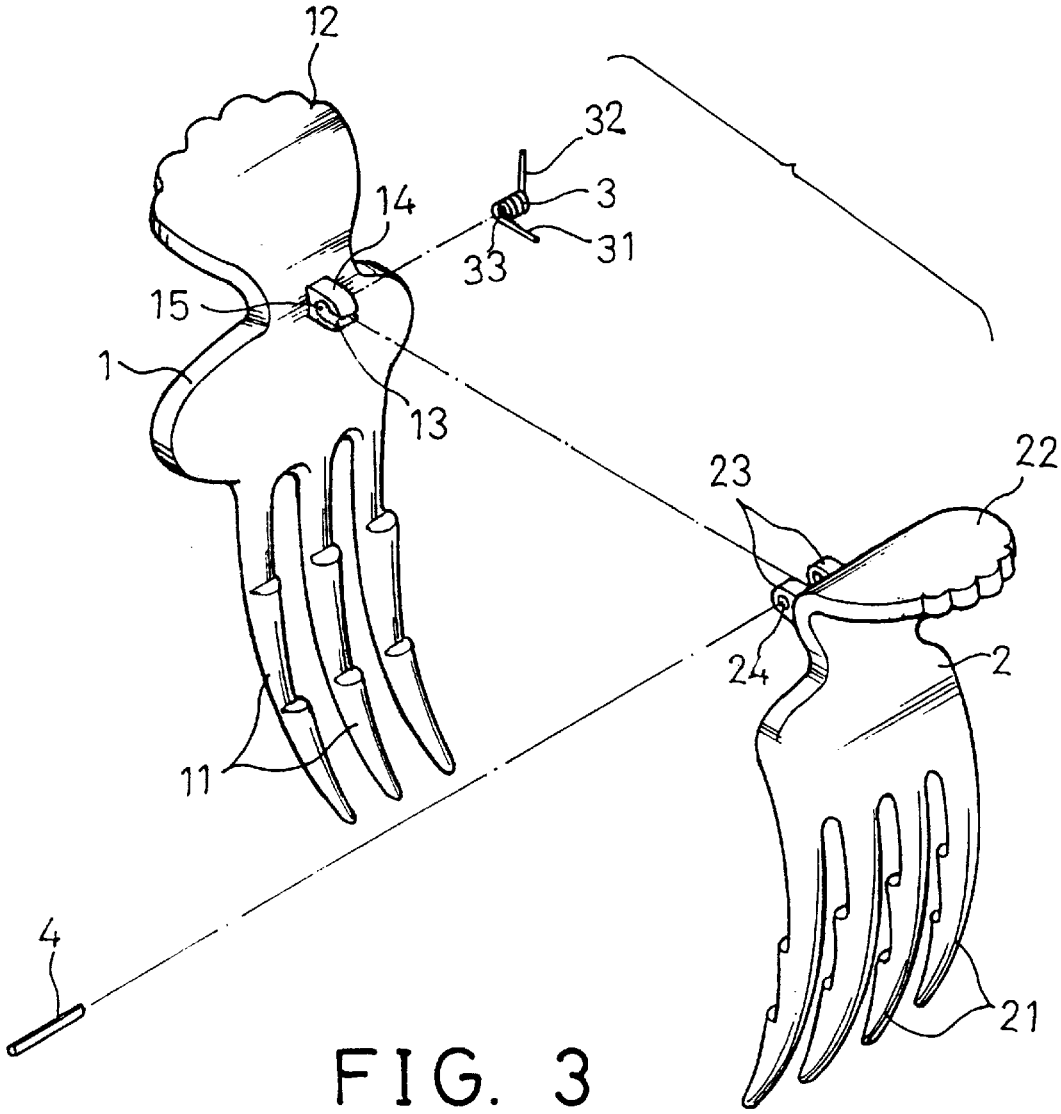
FIG. 3 is an exploded view of a hair styling device in accordance with the present invention.
Figure 4:
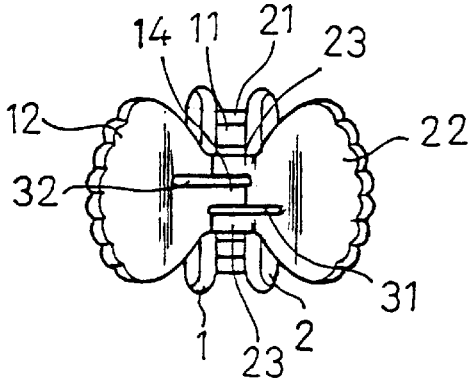
FIG. 4 is an end view of the hair styling device.
Figure 6:
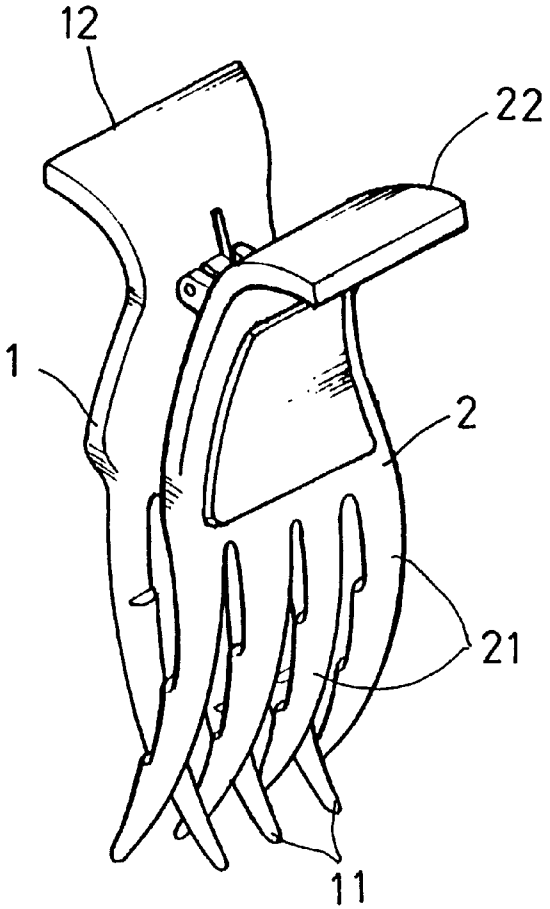
FIG. 6 is a perspective view similar to FIG. 5, illustrating the other embodiment of the hair styling device.
Figure 5:
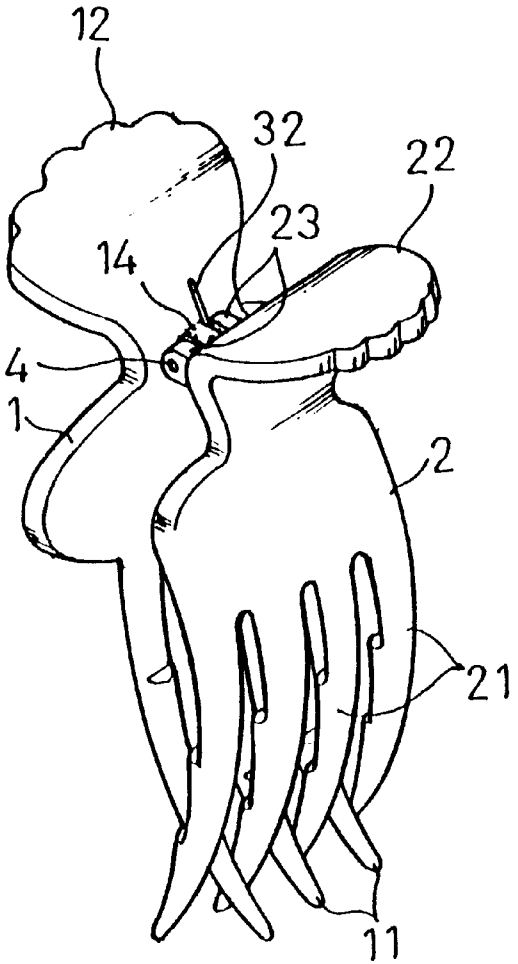
FIG. 5 is a perspective view of the hair styling device;.

Referring to the drawings, and initially to FIGS. 3–5, a hair styling device in accordance with the present invention comprises two clasp plates 1, 2 each including a comb 11, 21 formed or provided on one end thereof, and each including a handle 12, 22 formed or provided on the other end thereof, and each including a middle portion to be pivotally or rotatably secured together with a shaft 4. A coil spring 3 is to be engaged. onto the shaft 4 and includes an orifice 3 formed therein for receiving the shaft 4 and includes two legs 31, 32. As shown in FIG. 6, the clasp plates 1, 2 may be formed into various kinds of shapes or different shapes.

Figure 8:
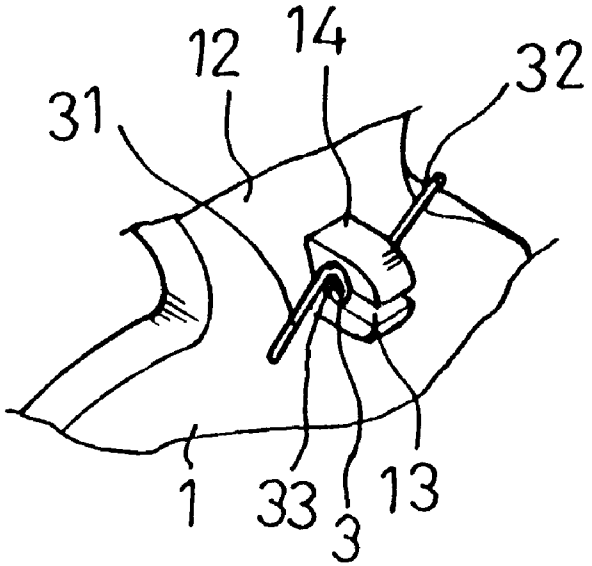
FIGS. 7 and 8 are partial perspective views illustrating the assembling of the coil spring onto the clasp plate of the hair styling device.
Figure 7:
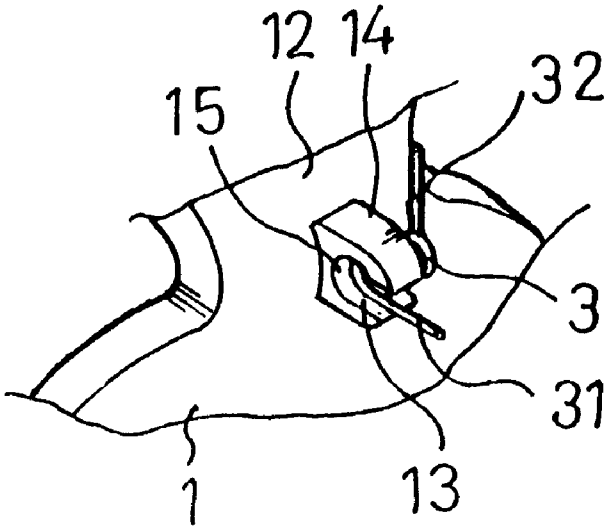

The clasp plate 1 includes a block 14 extended therefrom and having an aperture 15 formed therein and having a channel 13 formed therein and communicating with the aperture of the block 14. The aperture 15 includes a diameter greater than that of the channel 13 of the block 14 for receiving the coil spring 3 therein. The coil spring 3 includes a diameter equals to or smaller than that of the aperture 15 of the block 14 and greater than that of the channel 13 of the block 14 such that the coil spring 3 may be stably received and retained within the aperture 15 of the block 14, after one of the legs 31, 32 of the coil spring 3 is engaged through the channel 13 of the block 14, best shown in FIGS. 7 and 8. When one of the legs 31, 32 of the coil spring 3 has been engaged through the channel 13 of the block 14, the legs 31, 32 may sprung away or disengaged from the channel 13 of the block 14, such that the coil spring 3 may be stably retained within the aperture 15 of the block 14 and will not be disengaged from the block 14.

The other clasp plate 2 includes a pair of ears 23 to be engaged onto the sides of the block 14, and each having a hole 24 formed therein and to be aligned with the aperture 15 of the block 14 and the orifice 33 of the coil spring 3, such that the shaft 4 may be engaged through the ears 23 and the block 14 and the coil spring 3, in order to rotatably or pivotally secure the clasp plates 1, 2 together. As best shown in FIGS. 4 and 7–10, one of the legs 31, 32 of the coil spring 3 will be forced and engaged against the clasp plate 1, and only the other leg 31 is required to be forced or pulled upward when the block 14 is to be assembled or engaged into or between the ears 23 of the other clasp plate 2, such that the hair styling device may be easily and quickly assembled. As best shown in FIG. 4, only the legs 31, 32 of the coil spring 3 are exposed and extended or disposed between the block 14 and the ears 23.

Figure 10:
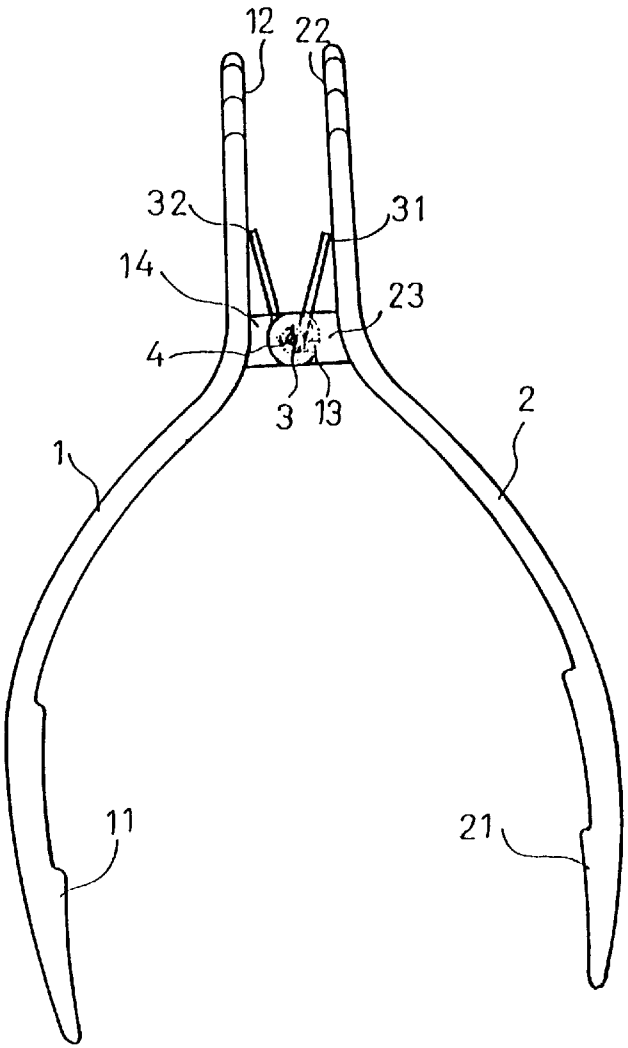
FIGS. 9 and 10 are plane schematic views illustrating the operation of the hair styling device.
Figure 9:
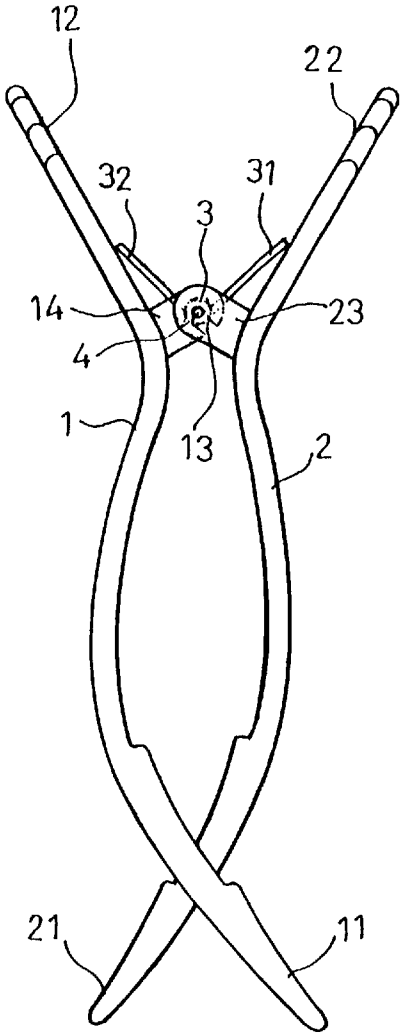

In operation, as shown in FIGS. 9 and 10, the combs 11, 21 of the clasp plates 1, 2 may be biased toward each other (FIG. 9) for hair styling purposes by the coil spring 3. The combs 11, 21 of the clasp plates 1, 2 may be moved away from each other (FIG. 10) against the coil spring 3 by the handles 12, 22 before the combs 11, 21 are engaged onto the hair of the users.

It is to be noted that the coil spring 3 may be stably retained in the aperture 15 of the block 14 while assembling, such that the coil spring 3 may be prevented from being disengaged from the block 14 and may be prevented from hurting the other people inadvertently. In addition, only one of the legs 31 of the coil spring 3 is required to be rotated or moved when engaging the block 14 into or between the ears 23 of the other clasp plate 2, such that the hair styling device to be easily manufactured and assembled. In addition, the coil spring 3 may be suitably shielded or received in the aperture 15 of the block 14 and may thus be prevented from being exposed and contacted with the environment air, such that the coil spring may be prevented from being dirtied or contaminated or rusted.

Accordingly, the hair styling device in accordance with the present invention includes a structure for allowing the hair styling device to be easily manufactured and assembled, and includes a coil spring that may be stably retained in place during assembling, for preventing the coil spring from hurting the other people inadvertently, and that may be shielded or received in a block for preventing the coil spring from being dirtied or contaminated or rusted.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A hair styling device comprising:

a) a first clasp plate including a block extended therefrom, said block including an aperture formed therein and including a channel formed therein and communicating with said aperture of said block, said aperture of said block including a diameter greater than that of said channel of said block, b) a second clasp plate including a pair of ears extended therefrom, said ears each including a hole formed therein and to be aligned with said aperture of said block, c) a coil spring received in said aperture of said block and including an orifice formed therein, and including two legs extended between said block and said ears and engaged with said first and said second clasp plates respectively for biasing said combs toward each other, said coil spring including a diameter greater than that of said aperture of said block for allowing said coil spring to be stably retained in said aperture of said block, said legs of said coil spring being engaged through said channel of said block for allowing said coil spring to be engaged into and stably retained in said aperture of said block, and d) a shaft engaged through said holes of said ears and said orifice of said coil spring for pivotally securing said clasp plates together.

2. The hair styling device according to claim 1, wherein said first and said second clasp plates each includes a comb provided thereon.

3. The hair styling device according to claim 2, wherein said first and said second clasp plates each includes a handle provided thereon for moving said combs away from each other against said coil spring.

* * * * *